United States Patent [19]

Boggs

[11] Patent Number: 4,860,360

[45] Date of Patent: Aug. 22, 1989

[54] METHOD OF EVALUATING SPEECH

[75] Inventor: George J. Boggs, Weston, Mass.

[73] Assignee: GTE Laboratories Incorporated, Waltham, Mass.

[21] Appl. No.: 34,505

[22] Filed: Apr. 6, 1987

[51] Int. Cl.[4] ..... G10L 9/08

[52] U.S. Cl. ..... 381/48; 381/46; 381/47

[58] Field of Search ..... 364/513.5, 38–50

[56] References Cited

U.S. PATENT DOCUMENTS

| | | | |
|---|---|---|---|
| 3,634,759 | 1/1972 | Tokorozawa et al. | 381/48 |
| 4,220,819 | 9/1980 | Atal | 381/38 |
| 4,509,133 | 4/1985 | Monbaron et al. | 364/513.5 |
| 4,592,085 | 5/1986 | Watari et al. | 381/43 |
| 4,651,289 | 3/1987 | Maeda et al. | 381/43 |

FOREIGN PATENT DOCUMENTS 2137791 10/1984 United Kingdom .

OTHER PUBLICATIONS

Klatt, "A Digital Filter Bank for Spectral Matching", *IEEE ICASSP*, 1976, pp. 573–576.

Campbell et al., "Voiced/Unvoiced Classification of Speech with Applications to the U.S. Government LPC-10E Algorithm", *ICASSP* 86, Tokyo, pp. 473–476, 1986.

*Primary Examiner*—Emanuel S. Kemeny
*Assistant Examiner*—David D. Knepper
*Attorney, Agent, or Firm*—James J. Cannon, Jr.

[57] ABSTRACT

A method of evaluating the quality of speech in a voice communication system is used in a speech processor. A digital file of undistorted speech representative of a speech standard for a voice communication system is recorded. A sample file of possibly distorted speech carried by said voice communication system is also recorded. The file of standard speech and the file of possibly distorted speech are passed through a set of critical band filters to provide power spectra which include distorted-standard speech pairs. A variance-covariance matrix is calculated from said pairs, and a Mahalanobis $D^2$ calculation is performed on said matrix, yielding $D^2$ data which represents an estimation of the quality of speech in the sample file.

16 Claims, 1 Drawing Sheet

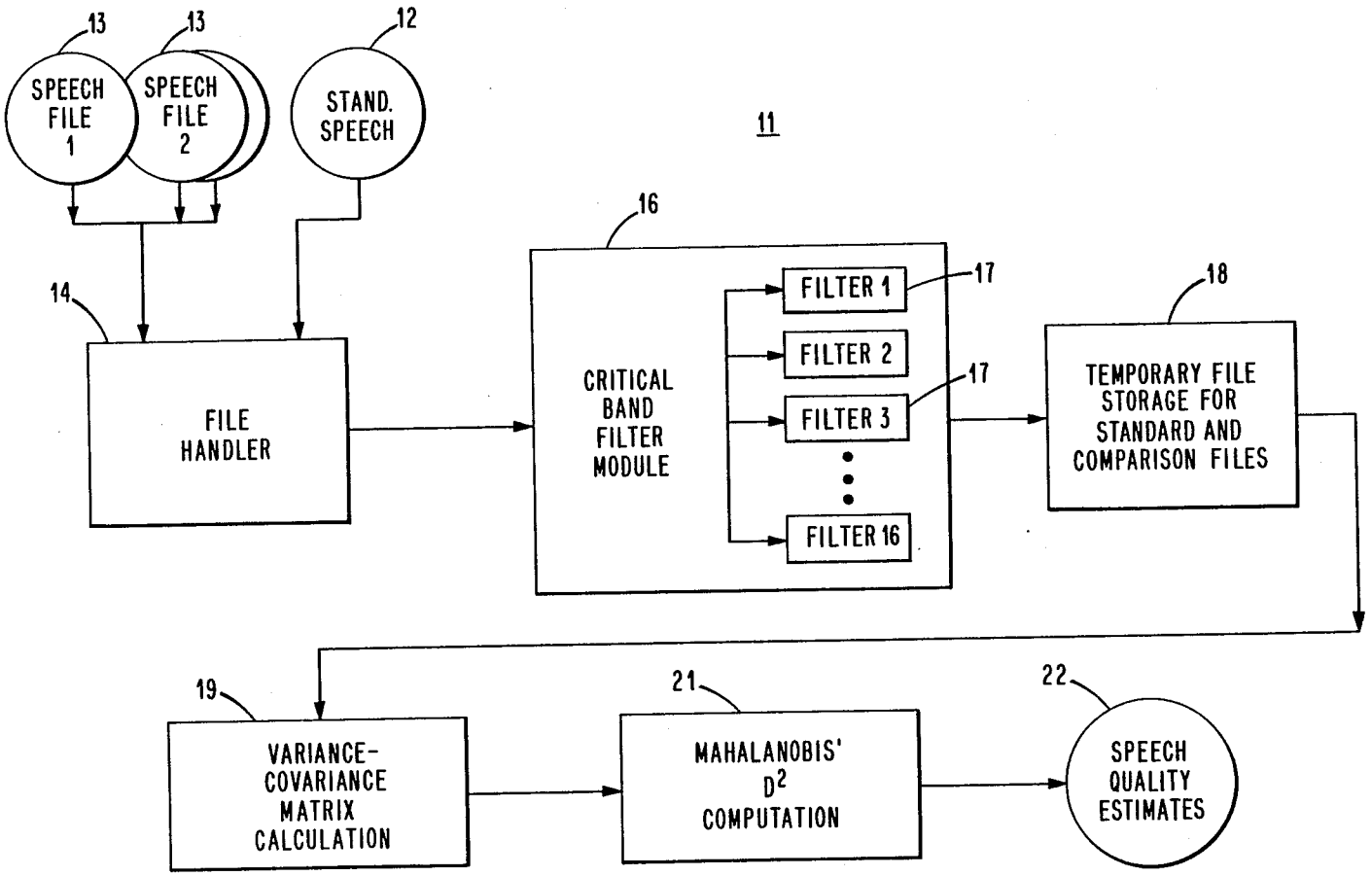
11
12
STAND. SPEECH
13
SPEECH FILE 1
13
SPEECH FILE 2
14
FILE HANDLER
16
CRITICAL BAND FILTER MODULE
17
FILTER 1
FILTER 2
FILTER 3
FILTER 16
17
18
TEMPORARY FILE STORAGE FOR STANDARD AND COMPARISON FILES
19
VARIANCE-COVARIANCE MATRIX CALCULATION
21
MAHALANOBIS' D2 COMPUTATION
22
SPEECH QUALITY ESTIMATES

METHOD OF EVALUATING SPEECH

BACKGROUND OF THE INVENTION

1. Field of the Invention

This invention relates to methods of evaluating the quality of speech, and, in particular, to methods of evaluating the quality of speech by means of an objective automatic system.

2. General Background

Speech quality judgments in the past were determined in various ways. Subjective, speech quality estimation was made by surveys conducted with human respondents. Some investigators attempted to evaluate speech quality objectively by using a variety of spectral distance measures, noise measurements, and parametric distance measures. Both the subjective techniques and the prior objective techniques were widely used, but each has its own unique set of disadvantages.

The purpose of speech quality estimation is to predict listener satisfaction. Hence, speech quality estimation obtained through the use of human respondents (subjective speech quality estimates) is the procedure of choice when other factors permit. Disadvantageously, the problems with conducting subjective speech quality studies often either preclude speech quality assessment or dilute the interpretation and generalization of the results of such studies.

First and foremost, subjective speech quality estimation is an expensive procedure due to the professional time and effort required to conduct subjective studies. Subjective studies require careful planning and design prior to the execution. They require supervision during execution and sophisticated statistical analyses are often needed to properly interpret the data. In addition to the cost of professional time, human respondents require recruitment and pay for the time they spend in the study. Such costs can mount very quickly and are often perceived as exceeding the value of speech quality assessment.

Due to the expense of the human costs involved in subjective speech quality assessment, subjective estimates have often been obtained in studies that have compromised statistical and scientific rigor in an effort to reduce such costs. Procedural compromises invoked in the name of cost have seriously diluted the quality of the data with regard to their generalization and interpretation. When subjective estimates are not generalized beyond the sample of people recruited to participate in the study, or even when the estimates are not generalized beyond some subpopulation within the larger population of interest, the estimation study has little real value. Similarly, when cost priorities result in a study that is incomplete from a statistical perspective (due to inadequate controlled conditions, unbalanced listening conditions, etc.), the interpretation of the results may be misleading. Disadvantageously, inadequately designed studies have been used on many occasions to guide decisions about the value of speech transmission techniques and signal processing systems.

Because cost and statistical factors are so common in subjective speech quality estimates, some investigators have searched for objective methods to replace the subjective methods. If a process could be developed that did not require human listeners as speech quality judges, that process would be of substantial utility to the voice communication industry and the professional speech community. Such a process would enable speech scientists, engineers, and product customers to quickly evaluate the utility of speech systems and quality of voice communication systems with minimal cost. There have been a number of efforts directed at designing an objective speech quality assessment process.

The prior processes that have been investigated have serious deficiencies. For example, an objective speech quality assessment process should correlate well with subjective estimates of speech quality and ideally achieve high correlations across many different types of speech distortions. The primary purpose for estimating speech quality is to predict listener satisfaction with some population of potential listeners. Assuming that subjective measures of speech quality correlate well with population satisfaction (and they should, if assessment is conducted properly), objective measures that correlate well with subjective estimates will also correlate well with population satisfaction levels. Further, it is often true that any real speech processing or voice transmission system introduces a variety of distortion types. Unless the objective speech quality process can correlate well with subjective estimates across a variety of distortion types, the utility of the process will be limited. No objective speech quality process previously reported in the professional literature correlated well with subjective measures. The best correlations obtained were for limited set of distortions.

SUMMARY OF THE INVENTION

It is the principal object of this invention to provide for a new and improved objective process for evaluating speech quality by incorporating models of human auditory processing and subjective judgment derived from psychoacoustic research literature.

Another object of this invention is to provide for a new and improved objective process of evaluating the quality of speech that correlates well with subjective estimates of speech quality, wherein said process can be over a wide set of distortion types.

Yet another object of this invention is to provide for a new and improved objective method of evaluating speech quality that utilizes software and digital speech data.

Still another object of this invention is to provide for a new and improved objective method of evaluating speech quality in which labor savings for both professional and listener time can be substantial.

In accordance with one aspect of this invention, a method of evaluating the quality of speech through an automatic testing system includes a plurality of steps. They include the preparation of input files. The first type of input file is a digital file of undistorted or standard speech utilizing a human voice. A second type of input file is a digital file of distorted speech. The standard speech by passed through the system to provide at least one possibly somewhat distorted speech file, since at least one distorted speech file is necessary to use the invention. A set of critical band filters is selected to encompass the bandpass characteristics of a communications network. The standard speech and the possibly distorted speech are passed through the set of filters to provide power spectra relative thereto. The power spectra obtained from the standard speech file and from the possibly somewhat distorted speech file are temporarily stored to provide a set of distorted-standard speech pairs. A variance-covariance matrix is prepared from the set of distorted-standard speech pairs, wherein diagonal elements for each matrix are calculated according to the equation $$MSWp = \frac{\Sigma (N_k - 1)(S_{kp})^2}{N_1 + N_2 - 2},$$

where MSW is the mean square within, $N_k$ is the number of observations in the $k^{th}$ vector, and $S_{kp}^2$ is the pooled variance over the set of observations, and off-diagonal elements are calculated by the equation $$MSWpp' = \frac{\Sigma (N_k - 1) r_{pp'} S_{kp} S_{kp'}}{N_1 + N_2 - 2},$$

where $r_{pp'}$ is the pooled correlation coefficient, and $S_{kp}$ and $S_{kp'}$ are the pooled standard deviations for the k vectors.

Mahalanobis' $D^2$ Calculation data are prepared by the equation:

$$D^2 = (X_1 - X_2)\Sigma_{xx}^{-1}(X_1 - X_2),$$

where $X_1$ and $S_2$ are sample mean vectors, and $\Sigma_{xx}^{-1}$ is the inverse of the variance-covariance matrix. A visual display is provided of the $D^2$ output data.

In accordance with certain features of the invention, the standard speech is prepared by digitally recording a human voice on a storage medium, and the set of critical band filters is selected to encompass the bandpass characteristics of the international telephone network (nominally 300 Hz to 3200 Hz). The set of filters can include fifteen filters having center frequencies, cutoff frequencies, and bandwidths, where the center frequencies range from 250 to 3400 Hz, the cutoff frequencies range from 300 to 3700 Hz, and the bandwidths range from 100 to 550 Hz. The center frequency is defined as that frequency in which there is the least filter attenuation. In such a method, the set of filters can include sixteen filters, the sixteenth filter having a center frequency of 4000 Hz, a cutoff frequency of 4400 Hz, and a bandwidth of 700 Hz. The visual display can be a printer or a video display. The possibly somewhat distorted speech can be recorded by various means including digital recording. The spectra from the standard speech and the possibly somewhat distorted speech file from the set of critical band filters can be temporarily stored via parallel paths. It can be temporarily stored by a serial path.

BRIEF DESCRIPTION OF THE DRAWING

Other objects, advantages, and features of this invention, together with its mode of operation, will become more apparent from the following description, when read in conjunction with the accompanying drawing, which indicates a software embodiment thereof.

DETAILED DESCRIPTION

A schematic description of a method of evaluating the quality of speech is depicted in the sole FIGURE. The evaluated speech processing method 11 has two major types of input files and five major functional processors. The file types and each of the functional processors is described in more detail below.

File Types

The evaluative speech processing method 11 reads two types of major files 12, 13. The first 12, denoted "standard speech" in the drawing, is a digital file of undistorted speech. For example, in a telephony application, the standard speech file contains a passage encoded as 64 kilobit pulse code modulated (PCM) speech. The choice of 64 kilobit PCM speech derives from the fact that 64 kilobit PCM is the international standard for digital telephone applications. Applications other than telephony may require standard speech files based on different coding rules. The files 13—13, labeled "speech file 1", "speech file 2", etc., are files that contain speech distorted by some means and whose quality is to be compared to the standard. The evaluative speech processing method utilizes the standard speech file and at least one distorted speech file for comparison purposes. Theoretically, there is no limit on the number of distorted speech files that may be processed.

File Handler

The file handler 14 primarily reads the files 12, 13 into the evaluative speech processing system 11 according to the format in which the speech was digitized and stored. The file handler 14 can have other functions at the discretion of the user. For example, noise can be added to a file at the time the file is read, for research purposes.

Critical Band Filters

The critical band filter bank 16 is a major functional module within the evaluative speech processing system 11; It includes a set of recursive digital filters 17—17 with filter parameters that can be set by the user. The default filter parameters, however, are taken from the psychoacoustic literature, and are described in Table 1 below. Note that Table 1 shows sixteen bandpass filters, although it is anticipated that only the first fifteen are necessary. The number of filters is selected to encompass the bandpass characteristics of the international telephone network (nominally 300 Hz to 3200 Hz). The default filter parameters were obtained empirically from experiments with human listeners.

TABLE 1

| Number | Center Freq. (Hz) | Cutoff (Hz) | Bandwidth (Hz) |
|---|---|---|---|
| 1 | 250 | 300 | 100 |
| 2 | 350 | 400 | 100 |
| 3 | 450 | 510 | 110 |
| 4 | 570 | 630 | 120 |
| 5 | 700 | 770 | 140 |
| 6 | 840 | 920 | 150 |
| 7 | 1000 | 1080 | 160 |
| 8 | 1170 | 1270 | 190 |
| 9 | 1370 | 1480 | 210 |
| 10 | 1600 | 1720 | 240 |
| 11 | 1850 | 2000 | 280 |
| 12 | 2150 | 2320 | 320 |
| 13 | 2500 | 2700 | 380 |
| 14 | 2900 | 3150 | 450 |
| 15 | 3400 | 3700 | 550 |
| 16 | 4000 | 4400 | 700 |

Temporary File Storage

Temporary file storage 18, coupled to receive the output of the sixteen filters 17 from the critical band filter module 16, stores the power spectra obtained from the standard speech file 12 and the distorted speech files 13 for subsequent usage.

Variance-Covariance Matrix Calculation

The variance-covariance matrix 19 for the set of distorted-standard speech pairs is calculated. The matrix is calculated according to standard procedures reported in the literature. See, for example, Marasculio, L. A. and Levin, J. R. *Multivariate Statistics in the Social Sciences,* Brooks/Cole Publishers, 1983. The standard elements for each matrix are calculated according to the equation $$MSWp = \frac{\Sigma\,(N_k - 1)\,(S_{kp})^2}{N_1 + N_2 - 2},$$

where $N_k$ is the number of observations in the $k^{th}$ vector, and $S_{kp}$ is the pooled variance over the set of observations. The off-diagonal elements are calculated by $$MSWpp' = \frac{\Sigma\,(N_k - 1)r_{pp'}S_{kp}S_{kp'}}{N_1 + N_2 - 2},$$

where $r_{pp'}$ is the pooled correlation coefficient, and $S_{kp}$ and $S_{kp'}$ are the pooled standard deviations for the k vectors. $N_k$ is defined as above.

Mahalanobis' $D^2$ Calculation

Mahalanobis' $D^2$ is a distance metric that was selected because it is a multidimensional generalization of the most widely used model of auditory judgmental processes (i.e., unidimensional signal detection theory). Mahalanobis' $D^2$ is calculated with the following equation:

$$D^2=(X_1-X_2)\Sigma_{xx}^{-1}(X_1-X_2),$$

where $X_1$ and $X_2$ are the sample mean vectors, and $\Sigma_{xx}^{-1}$ is the inverse of the variance-covariance matrix. Again, the singular relevance of the $D^2$ measure is that $D^2$ has been the modal model used to describe and predict human performance in auditory tasks.

Speech Quality Estimates

Speech quality estimates at 22, display the $D^2$ output data either on a screen of a visual display terminal or on a line printer.

Although the various steps set forth above are preferably subroutines in a computer program, functionally identical modules can be realized in hardware or firmware. An important application area for evaluative speech processing may be as a test module present within a voice telecommunications network. Such test modules could monitor the network constantly. When speech quality estimates fall below a given criterion an alarm could be enabled in a centralized Network Control Center to indicate that quality of service was degraded. Network maintenance personnel could then be dispatched after isolation of the fault that led to service degradation. In such an example, a software embodiment may be inappropriate for evaluation because of its relatively slow speed. Evaluative speech processing would function better and in real-time only if embodied in hardware form, which processor could perform the method as set forth herein.

The general techniques outlined above could be extended to other fields. For example, one major application could be in the area of image quality. Image quality is important for both military and civilian applications as more and more image data are transmitted over telecommunication networks. To achieve an objective image quality assessment tool, a model of visual processing would be substituted for the critical band model of auditory processing.

This invention utilizes the use of psychoacoustically-derived models of human auditory processing and judgmental processes in an objective speech quality evaluation tool, whereas the prior art had used either sophisticated statistical models that did not reflect the underlying processes ongoing in the auditory system or used measurements of the physical characteristics of the speech waveform (e.g., segmental signal-to-noise ratio).

Recap

Generally, a standard of speech is obtained by recording human voice onto a tape in a known manner. That standard speech is one input to a file handler 12, of a system which applies that standard of speech to a sample from a system under test. The output of that system under test is inserted into a speech file 13, such as speech file 1, or speech file 2. That speech file 13 is also applied to the file handler 14. The file handler 14 can be a software device or it can be a tape reader, which can read the information from the two files 12, 13. The information for the file handler 14 is transmitted to a set of critical band filters 17, filter 1 through filter 16, although possibly fifteen can be effective as sixteen. The output of the various filters 17, containing the two sets of speech, is transmitted to a temporary file storage 18 with standard and comparison files. The data that appears in the two different sets of speeches 12, 13 are compared and numerically evaluated to determine the speech quality estimates. Specifically, as shown in the drawing, the information undergoes a variance-covariance matrix calculation 19 and Mahalanobis' $D^2$ computation 21 to yield the speech quality estimates. The mathematics for the variance-covariance matrix calculation, and the Mahalanobis' $D^2$ computation is set forth above. The Mahalanobis' computation is preferred because of its effectiveness and, through psychoacoustical research, it has been found that it is possibly the best method. The variance-covariance matrix calculation is required to provide necessary data for the Mahalanobis' computation.

Mahalanobis' calculation yields a number ranging from zero to a high positive number. Because of Mahalanobis' computation, it necessarily follows that a zero or positive number results. As for the speech file 1, speech file 2, and other speech files, it is possible that a telephone company may desire to test its particular system with or without some device that may be added thereto, and to determine whether or not the added device causes distortion or additional distortion in the system. This overall evaluation speech processor determines differences, if any, in distortion with a 95% accuracy. In trying to forecast scientific expectations, a model is desired. Through psychoacoustic research, the most accurate model for forecasting human performance, when humans are comparing sound, is a Mahalanobis' $D^2$ computation. The Mahalanobis' $D^2$ is a model of human judgment process. Critical band filters model the human hearing process. Quality is judged when heard, and a judgment is then made. This invention involves making a model of such a hearing and then a model of the judgment. This invention, though comparing standard speech versus distorted speech, involves using the combination of auditory and judgmental processes to achieve speech quality results which have not been previously performed successfully as reported in the literature.

Various modifications may be performed without departing from the spirit and scope of this invention.

I claim:

1. A method of evaluating the quality of speech in a voice communication system comprising:

selecting a digital file of undistorted speech representative of a speech standard satisfying specified criteria for said voice communication system;

selecting a sample file of speech carried by said voice communication system for qualitative comparison with said file of standard speech, said sample file including at least one possibly distorted speech sample;

inputting said standard speech file and said sample speech file into an evaluative speech processor;

processing said files through a plurality of critical bandpass filters having filter parameters representative of the bandpass characteristics of said voice communication system and of human auditory activity obtained from empirical observations;

storing temporarily the power spectra obtained from said standard speech file and said sample speech file, said power spectra providing a set of distorted-standard speech pairs;

calculating a variance-covariance matrix from said set of distorted-standard speech pairs, wherein diagonal elements for each matrix are calculated according to $$MSWp = \frac{\Sigma (N_k - 1)(S_{kp})^2}{N_1 + N_2 - 2},$$

where MSW is the mean square within, $N_k$ is the number of observations in the kth vector, and $S_{kp}^2$ is the pooled variance over the set of observations, and off-diagonal elements are calculated by $$MSWpp' = \frac{\Sigma (N_k - 1) r_{pp'} S_{kp} S_{kp'}}{N_1 + N_2 - 2},$$

where $r_{pp'}$ is the pooled correlation coefficient, and $S_{kp}$ and $S_{kp'}$ are the pooled standard deviations for the k vectors;

processing Mahalanobis' $D^2$ Calculation data by the equation:

$$D^2 = (X_2)\Sigma_{xx}^{-1}(X_1 - X_2),$$

where $X_1$ and $X_2$ are the sample mean vectors, and $\Sigma_{xx}^{-1}$ is the inverse of the variance-covariance matrix; and outputting said $D^2$ data, which represents the speech quality estimate of said sample speech file.

2. The method as recited in claim 1 wherein said standard of speech is selected by recording a human voice on a storage medium; and wherein said set of filters is selected to encompass the bandpass characteristics of the international telephone network (nominally 300 Hz to 3200 Hz).

3. The method as recited in claim 1 wherein said set of filters includes fifteen filters having center frequencies, cutoff frequencies, and bandwidths, respectively, as follows:

| Number | Center Freq. (Hz) | Cutoff (Hz) | Bandwidth (Hz) |
|---|---|---|---|
| 1 | 250 | 300 | 100 |
| 2 | 350 | 400 | 100 |
| 3 | 450 | 510 | 110 |
| 4 | 570 | 630 | 120 |
| 5 | 700 | 770 | 140 |
| 6 | 840 | 920 | 150 |
| 7 | 1000 | 1080 | 160 |
| 8 | 1170 | 1270 | 190 |
| 9 | 1370 | 1480 | 210 |
| 10 | 1600 | 1720 | 240 |
| 11 | 1850 | 2000 | 280 |
| 12 | 2150 | 2320 | 320 |
| 13 | 2500 | 2700 | 380 |
| 14 | 2900 | 3150 | 450 |
| 15 | 3400 | 3700 | 550 |

wherein center frequency is defined as that frequency in which there is the least filter attenuation.

4. The method as recited in claim 3 wherein said set of filters includes sixteen filters, the sixteenth filter having a center frequency, a cutoff frequency, and a bandwidth as follows:

| No. | Center Frequency (Hz) | Cutoff Frequency (Hz) | Bandwidth (Hz) |
|---|---|---|---|
| 16 | 4000 | 4400 | 700 |

5. The method as recited in claim 1 wherein said sample file of possibly distorted speech is recorded.

6. The method as recited in claim 5 wherein said possibly distorted speech is digitally recorded.

7. The method as recited in claim 1 wherein said spectra from said standard of speech file and said sample file of possibly distorted speech, and from said set of bandpass filters, is temporarily stored via parallel paths.

8. The method as recited in claim 1 wherein said spectra from said standard of speech file and said sample file of possibly distorted speech file, from said set of bandpass filters, is temporarily stored via a serial path.

9. An evaluative speech processor for evaluating the quality of speech carried by a voice communication system, comprising:

means to select a digital file of undistorted speech representative of a speech standard satisfying specified criteria for said voice communication system;

means to select a sample file of speech carried by said voice communication system for qualitative comparison with said file of standard speech, said sample file including at least one possibly distorted speech samples;

means to input said standard speech file and said sample speech file into an evaluative speech processor;

means to process said files through a plurality of critical bandpass filters having filter parameters representative of the bandpass characteristics of said voice communication system and of human auditory activity obtained from empirical observations;

means to store temporarily the power spectra obtained from said standard speech file and said sample file, said power spectra providing a set of distorted-standard speech pairs;

means to calculate a variance-convariance matrix from said set of distorted-standard speech pairs, wherein diagonal elements for each matrix are calculated according to $$MSWp = \frac{\Sigma (N_k - 1)(S_{kp})^2}{N_1 + N_2 - 2},$$

where MSW is the mean square within, $N_k$ is the number of observations in the kth vector, and $S_{kp}^2$ is the pooled variance over the set of observations, and off-diagonal elements are calculated by $$MSWpp' = \frac{\Sigma (N_k - 1) r_{pp'} S_{kp} S_{kp'}}{N_1 + N_2 - 2},$$

where $r_{pp'}$ is the pooled correlation coefficient, and $S_{kp}$ and $S_{kp'}$ are the pooled standard deviations for the k vectors;

means to process Mahalanobis' $D^2$ Calculation data by the equation:

$$D^2 = (X_1 - X_2)\Sigma_{xx}^{-1}(X_1 - X_2),$$

where $X_1$ and $X_2$ are the sample mean vectors, and $\Sigma_{xx}^{-1}$ is the inverse of the variance-covariance matrix; and means to output said $D^2$ data, which represents the speech quality estimate of said sample speech file.

10. The evaluative speech processor of claim 9 wherein said set of filters is selected to encompass the bandpass characteristics of the international telephone network (nominally 300 Hz to 3200 Hz).

11. The evaluative speech processor of claim 9 wherein said set of filters includes fifteen filters having center frequencies, cutoff frequencies, and bandwidths, respectively, as follows:

| Number | Center Freq. (Hz) | Cutoff (Hz) | Bandwidth (Hz) |
|---|---|---|---|
| 1 | 250 | 300 | 100 |
| 2 | 350 | 400 | 100 |

-continued

| Number | Center Freq. (Hz) | Cutoff (Hz) | Bandwidth (Hz) |
|---|---|---|---|
| 3 | 450 | 510 | 110 |
| 4 | 570 | 630 | 120 |
| 5 | 700 | 770 | 140 |
| 6 | 840 | 920 | 150 |
| 7 | 1000 | 1080 | 160 |
| 8 | 1170 | 1270 | 190 |
| 9 | 1370 | 1480 | 210 |
| 10 | 1600 | 1720 | 240 |
| 11 | 1850 | 2000 | 280 |
| 12 | 2150 | 2320 | 320 |
| 13 | 2500 | 2700 | 380 |
| 14 | 2900 | 3150 | 450 |
| 15 | 3400 | 3700 | 550 |

wherein center frequency is defined as that frequency in which there is the least filter attenuation.

12. The evaluative speech processor of claim 11 wherein said set of filters includes sixteen filters, the sixteenth filter having a center frequency, a cutoff frequency, and a bandwidth as follows:

| No. | Center Frequency (Hz) | Cutoff Frequency (Hz) | Bandwidth (Hz) |
|---|---|---|---|
| 16 | 4000 | 4400 | 700 |

13. The evaluative speech processor of claim 9 wherein said sample file of possibly distorted speech is recorded.

14. The evaluative speech processor as recited in claim 13 wherein said sample file of possibly distorted speech is digitally recorded.

15. The evaluative speech processor as recited in claim 9 wherein said spectra from said standard of speech file and said sample file of possibly distorted speech, and from said set of bandpass filters, is temporarily stored via parallel paths.

16. The evaluative speech processor as recited in claim 9 wherein said spectra from said standard of speech file and said sample file of possibly distorted speech file, from said set of bandpass filters, is temporarily stored via a serial path.

* * * * *